US007320822B2

(12) United States Patent
Ashibe et al.

(10) Patent No.: US 7,320,822 B2
(45) Date of Patent: Jan. 22, 2008

(54) ELECTROPHOTOGRAPHIC CONDUCTIVE MEMBER AND ELECTROPHOTOGRAPHIC APPARATUS

(75) Inventors: Tsunenori Ashibe, Kanagawa (JP); Ryota Kashiwabara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 10/995,358

(22) Filed: Nov. 24, 2004

(65) Prior Publication Data

US 2005/0118421 A1 Jun. 2, 2005

(30) Foreign Application Priority Data

Nov. 28, 2003 (JP) ..... 2003-399886

(51) Int. Cl.
*B41M 5/00* (2006.01)
*B44C 1/17* (2006.01)
*G03G 7/00* (2006.01)

(52) U.S. Cl. ..... 428/195.1; 399/162; 399/176; 399/279; 399/286; 399/297; 399/308; 399/313; 430/62

(58) Field of Classification Search ..... 428/195.1; 399/162, 176, 279, 286, 297, 308, 313; 430/62
See application file for complete search history.

(56) References Cited

U.S. PATENT DOCUMENTS

| | | | | |
|---|---|---|---|---|
| 4,087,505 | A * | 5/1978 | Sugimoto et al. | 264/564 |
| 5,021,036 | A | 6/1991 | Tanaka et al. | 474/237 |
| 5,419,993 | A * | 5/1995 | Sakakibara et al. | 430/62 |
| 5,492,767 | A * | 2/1996 | Yazaki et al. | 428/500 |
| 5,789,506 | A * | 8/1998 | Toribuchi et al. | 526/214 |
| 6,673,499 | B2 * | 1/2004 | Lee et al. | 430/57.1 |
| 2005/0064152 | A1 * | 3/2005 | Aylward et al. | 428/195.1 |

FOREIGN PATENT DOCUMENTS

| | | |
|---|---|---|
| JP | 3-89357 | 4/1991 |

* cited by examiner

*Primary Examiner*—Milton I. Cano
*Assistant Examiner*—David J. Joy
(74) *Attorney, Agent, or Firm*—Fitzpatrick, Cella, Harper & Scinto

(57) ABSTRACT

In an electrophotographic conductive member composed of at least a thermoplastic resin composition, the thermoplastic resin composition contains a thermoplastic resin, a conductive filler and a conductive-filler dispersing agent, and the conductive-filler dispersing agent is a polyhydric alcohol type nonionic surface-active agent.

7 Claims, 4 Drawing Sheets

ELECTROPHOTOGRAPHIC CONDUCTIVE MEMBER AND ELECTROPHOTOGRAPHIC APPARATUS

This application claims priority from Japanese Patent Application No. 2003-399886, filed Nov. 28, 2003, which is incorporated herein by reference.

BACKGROUND OF THE INVENTION

1. Field of the Invention

This invention relates to an electrophotographic conductive member, such as a charging member, a developer carrying member, an intermediate transfer member or a transfer material transporting member, and an electrophotographic apparatus having the electrophotographic conductive member.

2. Related Background Art

Various systems, such as an electrophotographic system, a thermal transfer system and an ink-jet system, have conventionally been employed in an image forming apparatus. Of these, an image forming apparatus employing the electrophotographic system, what is called an electrophotographic apparatus, is superior to an image forming apparatus employing other systems due to its high speed, high image quality and lack of noise.

The electrophotographic system is a system in which the surface of an electrophotographic photosensitive member is primarily electrostatically charged (a primary charging step), thereafter an electrostatic latent image is formed on the surface of the electrophotographic photosensitive member by an exposure (an exposure step), this electrostatic latent image is developed with a toner to form a developed image (a developing step), and thereafter this developed image is transferred to a transfer material (a transfer step). In the primary charging step or the transfer step, a charging member, such as a primary charging roller or a transfer charging roller, is used. In the developing step, a developer carrying member, such as a developing roller, is used.

In addition, not only monochrome electrophotographic apparatuses, but also polychrome (color) electrophotographic apparatuses (color electrophotographic apparatus) have become popular.

Various systems are employed in such color electrophotographic apparatuses. For example, well known are an intermediate transfer system in which primary charging, exposure and development are successively performed for each color by means of a single electrophotographic photosensitive member, and respective-color toner images are primarily sequentially transferred onto an intermediate transfer member (such as an intermediate transfer drum or an intermediate transfer belt), where the toner images thus transferred are thereafter secondarily transferred in a lump onto a transfer material to form a color image; and an in-line system in which respective-color toner images are respectively formed in respective-color image forming sections disposed in series (each having an electrophotographic photosensitive member, a primary charging means, an exposure means, a developing means, a transfer means and so forth), and the toner images thus formed are sequentially transferred to a transfer material and transported to the respective image forming sections, in turn, to form a color image.

The color electrophotographic apparatus of an intermediate transfer system has an advantage in that a great variety of transfer materials can be selected without regard to the differences in their width, length and thickness because it is unnecessary to process or control the transfer material (such as paper), e.g., hold it on a gripper, attract it to the electrophotographic photosensitive member or make it have a curvature. The color electrophotographic apparatus of an in-line system also has an advantage in that a color image is formed through one step and images can be reproduced at a high speed.

However, these electrophotographic conductive members, such as a charging member, a developer carrying member, an intermediate transfer member and a transfer material transporting member, have the following technical problems.

The electrophotographic conductive members, such as a charging member, a developer carrying member, an intermediate transfer member and a transfer material transporting member, are commonly produced using thermoplastic resin compositions. Also, in providing the electrophotographic conductive members with conductivity, a method is commonly used in which a conductive filler is dispersed in the thermoplastic resin composition and may agglomerate when its surface energy is higher than the surface energy of the thermoplastic resin in the thermoplastic resin composition.

If the conductive filler agglomerates, it may disperse poorly, resulting in a non-uniform density of the conductive filler in the thermoplastic resin composition. This makes the electrical resistance of the electrophotographic conductive members unstable and makes any desired electrical resistance unachievable. Also, if the non-uniformity density of the conductive filler in the thermoplastic resin composition results in protrusions or the like on the surfaces of the electrophotographic conductive members, faulty reproduced images may appear or leaks may occur due to these protrusions. In such a case, it is difficult to obtain satisfactory products and their yield may be poor, resulting in a high production cost.

As a countermeasure for these problems, Japanese Patent Application Laid-open No. H03-089357 discloses a technique in which a conductive filler and every kind of dispersing agent (such as wax) are mixed.

However, the technique disclosed in Japanese Patent Application Laid-open No. H03-089357 requires the use of a dispersing agent in an amount equal to or greater than the amount of the conductive filler. For example, where the electrophotographic conductive members having the desired conductivity are formed, the total amounts of the conductive filler and dispersing agent may inevitably be close to about 50% of the amount of the thermoplastic resin composition. This has, in some cases, caused a substantial decrease in physical properties of the thermoplastic resin composition or the electrophotographic conductive members making use of the same.

A cationic surface-active agent is also available as a dispersing agent that may be added in a small quantity. The cationic surface-active agent, however, tends to bleed. Hence, the electrical resistance on the surfaces of the electrophotographic conductive members may change, or some bleeding matter may contaminate the electrophotographic photosensitive member or cause a break in the electrophotographic photosensitive member at its surface. This resulted in faulty reproduced images in some cases.

SUMMARY OF THE INVENTION

An object of the present invention is to provide, at a low cost, a high-quality electrophotographic conductive member having solved the above technical problems, and an electrophotographic apparatus having such an electrophotographic conductive member.

That is, the present invention is related to an electrophotographic conductive member composed of at least a thermoplastic resin composition, wherein:

the thermoplastic resin composition contains a thermoplastic resin, a conductive filler and a conductive-filler dispersing agent, and the conductive-filler dispersing agent is a polyhydric alcohol type nonionic surface-active agent.

The present invention also relates to an electrophotographic apparatus having the above electrophotographic conductive member.

DESCRIPTION OF THE PREFERRED EMBODIMENTS

Figure 1:
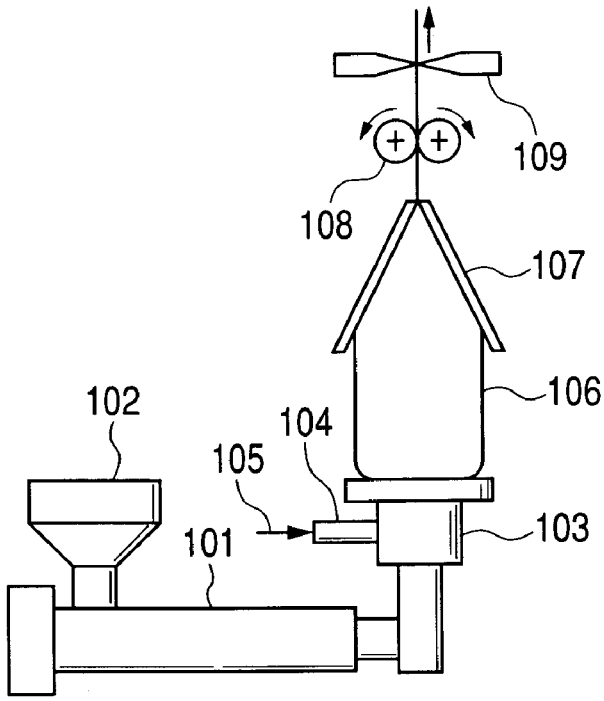
FIG. 1 is a schematic view showing an example of the construction of an apparatus for producing an electrophotographic endless belt, which employs a blown-film extrusion (inflation) method.

The electrophotographic conductive member of the present invention is formed of a thermoplastic resin composition containing a conductive filler and a conductive-filler dispersing agent comprising a polyhydric alcohol type nonionic surface-active agent.

The use of the polyhydric alcohol type nonionic surface-active agent as the conductive-filler dispersing agent enables the reduction of the surface activity of the conductive filler, control of agglomeration of the conductive filler and stabilization of dispersion of the conductive filler, and hence, prevents electrical-resistance non-uniformity, faulty reproduced images and leaks, which conventionally occurred due to a faulty dispersion of the conductive filler.

The use of a small quantity of the polyhydric alcohol type nonionic surface-active agent as the conductive-filler dispersing agent also results in a conductive filler dispersion stabilization effect. Hence, the bleeding of the dispersing agent cannot easily occur, and neither changes in surface resistance of the electrophotographic conductive member nor contamination of the electrophotographic photosensitive member may occur. Moreover, even where only slight bleeding has occurred, the surface of the electrophotographic photosensitive member cannot easily break.

The polyhydric alcohol type nonionic surface-active agent used in the present invention may include glycerol fatty esters, pentaerythritol fatty esters, sorbitol fatty esters and sorbitan fatty esters. Of these, glycerol fatty esters are preferred. Of the glycerol fatty esters, polyglycerol poly-ricinolate and polyglycerol stearate are more preferred.

Polyglycerol poly-ricinolate and polyglycerol stearate, both having high decomposition temperatures (295° C. and 273° C., respectively), are usable in resin compositions made from commonly available thermoplastic resins. Polyglycerol poly-ricinolate and polyglycerol stearate also very safe.

The thermoplastic resin, which is a chief material of the thermoplastic resin composition used in the electrophotographic conductive member of the present invention, may include olefin resins, such as polyethylene and polypropylene, polystyrene resins, acrylic resins, polyester resins, polycarbonate resins, sulfur-atom-containing resins, such as polysulfone, polyether sulfone and polyphenylene sulfide, fluorine-atom-containing resins, such as polyvinylidene fluoride, and a polyethylene-tetrafluoroethylene copolymer, polyurethane resins, silicone resins, ketone resins, polyvinylidene chloride, thermoplastic polyimide resins, polyamide resins, modified polyphenylene oxide resins, vinyl acetate resins, phenolic resins, epoxy resins, ABS resins, ionomer resins, acrylic resins, polyvinyl alcohol (PVA), polyvinyl butyral, an ethylene-vinyl acetate copolymer (EVA), an ethylene-vinyl alcohol copolymer (EVOH), vinylidene chloride resins, and celluloses.

Incidentally, the thermoplastic resin used in the present invention may encompass not only plastic thermoplastic resins but also elastic thermoplastic resins called thermoplastic elastomers.

The conductive filler used in the electrophotographic conductive member of the present invention may include, e.g., carbon black, and particles of graphite, aluminum-doped zinc oxide, titanium oxide coated with tin oxide, tin oxide, barium oxide coated with tin oxide, potassium titanate, aluminum, and nickel. Of these, preferred is carbon black, which can exhibit conductivity even if used in small quantities, keep mechanical physical properties of the electrophotographic conductive member from deteriorating, and has a good compatibility with the polyhydric alcohol type nonionic surface-active agent.

A filler, such as barium sulfate or any kind of whisker, may also optionally be used.

An ionic conducting agent may also be used in combination, as an auxiliary material, which provides the electrophotographic conductive member with conductivity.

The polyhydric alcohol type nonionic surface-active agent may preferably be contained in the thermoplastic resin composition in an amount of from 0.1 to 5.0% by weight based on the total weight of the thermoplastic resin composition, in an amount of from 1 to 20% by weight based on the weight of the conductive filler in the thermoplastic resin composition, and in an amount of from 0.05 to 4.5% by weight based on the weight of the thermoplastic resin in the thermoplastic resin composition. If the quantity of the polyhydric alcohol type nonionic surface-active agent is too small, the conductive filler dispersion stabilization effect may be poor. If too much dispersing agent is used, it may come out of the resin or deteriorate the mechanical and physical properties of the electrophotographic conductive member.

The conductive filler may also preferably be contained in the thermoplastic resin composition in an amount of from 2.0 to 60.0% by weight based on the total weight of the thermoplastic resin composition, and in an amount of from 2.0 to 150% by weight based on the weight of the thermoplastic resin in the thermoplastic resin composition. If the quantity of the conductive filler is too small, the electrophotographic conductive member may have insufficient conductivity. If too much conductive filler is used, the electrophotographic conductive member may have poor mechanical and physical properties.

As methods for mixing the conductive filler and the polyhydric alcohol type nonionic surface-active agent, a dry method and a wet method are available. As the dry method, a method is available in which the conductive filler and the polyhydric alcohol type nonionic surface-active agent are mixed by means of any type of mixer. As the wet method, a method is available in which the polyhydric alcohol type nonionic surface-active agent is diluted with any type of solvent and the conductive filler is introduced into the resultant diluted solution, followed by removal of the solvent by means of any type of dryer. The dry method has an advantage in that it can have a low cost, and the wet method has an advantage in that the polyhydric alcohol type nonionic surface-active agent adheres uniformly to particle surfaces of the conductive filler. Accordingly, the dry method and the wet method may properly be used based on the desired purpose.

As methods for dispersing the conductive filler in the thermoplastic resin by the aid of the polyhydric alcohol type nonionic surface-active agent, available are a method in which it is dispersed by means of any type of extruder, such as a twin-screw extruder or a single-screw extruder, and a method in which it is dispersed by means of any type of mixer, such as a kneader or Banbury mixer, or any type of roll mill, such as a two-roll mill or a three-roll mill. The twin-screw extruder is preferred in order to control dispersion. This is because, in the twin-screw extruder, the screw construction is easily changed, conditions for an adequate dispersed state can be met with ease by changing the screw construction, the throughput and the number of screw revolution can be individually controlled, and hence, the retention time of the thermoplastic resin can be changed with ease, the state of dispersion can be changed even in if the screw is not changed, and optimum conditions for dispersion can be found with ease.

The electrophotographic conductive member of the present invention may have the shape of a roller, the shape of a drum, the shape of a blade or the shape of a belt. There are no particular limitations on the shape. However, the shape of a roller is preferred when the electrophotographic conductive member of the present invention is used as a charging member or a developer carrying member, and the shape of a belt is preferred when used as an intermediate transfer member or a transfer material transporting member. The shape of a roller is, e.g., the shape in which a roller-shaped support (mandrel) is covered thereon with the thermoplastic resin composition, which is in tubular form.

The electrophotographic conductive member of the present invention may have volume resistivity and surface resistivity, which are selected according to the purpose of the electrophotographic conductive member. Where the electrophotographic conductive member of the present invention is used as a charging member, it may preferably have a volume resistivity of from $1\times10^{3}$ to $1\times10^{11}$ Ω·cm and a surface resistivity of from $1\times10^{3}$ to $5\times10^{11}$Ω. Where the electrophotographic conductive member of the present invention is used as a developer carrying member, it may preferably have a volume resistivity of from $1\times10^{4}$ to $1\times10^{9}$ Ω·cm and a surface resistivity of from $1\times10^{4}$ to $1\times10^{10}$Ω. Where the electrophotographic conductive member of the present invention is used as an intermediate transfer member, it may preferably have a volume resistivity of from $1\times10^{6}$ to $1\times10^{14}$ Ω·cm and a surface resistivity of from $1\times10^{6}$ to $1\times10^{14}$Ω. Where the electrophotographic conductive member of the present invention is used as a transfer material transporting member, it may preferably have a volume resistivity of from $1\times10^{7}$ to $5\times10^{14}$ Ω·cm and a surface resistivity of from $1\times10^{7}$ to $1\times10^{15}$Ω.

The electrophotographic conductive member of the present invention may also have volume resistivity and surface resistivity whose maximum values are within 100 times their minimum values in both the peripheral direction and the generatrix direction.

For example, where the electrophotographic conductive member of the present invention is used as a transfer material transporting member or an intermediate transfer member, if the maximum value of the volume resistivity in the peripheral direction is larger than 100 times the minimum value or if the maximum value of the surface resistivity in the peripheral direction is larger than 100 times the minimum value, image non-uniformity may occur in the peripheral direction. Also, where voltage is applied at a plurality of spots (e.g., where transfer voltage is applied at a plurality of spots), electric current may flow from a certain spot at which the voltage is applied into other spot(s) via a part having a low electrical resistance in the peripheral direction, to disturb voltage control at other spot(s). This may make any normal operation unachievable.

If the maximum value of the volume resistivity in the generatrix direction is larger than 100 times the minimum value, image non-uniformity may occur in the generatrix direction. Also, excess electrical current may flow into a portion having the minimum volume resistivity, so that the electrophotographic apparatus may not properly operate.

If the maximum value of the surface resistivity in the generatrix direction is larger than 100 times the minimum value, image non-uniformity may occur in the generatrix direction. Also, where a cleaning method is employed in which stated electric charges are imparted to a transfer residual toner to return it to the electrophotographic photosensitive member, excess electrical current may flow from a charging member, which imparts the electric charges, into a portion having the minimum surface resistivity in the electrophotographic conductive member. At such a portion, no sufficient electric field is applied in its generatrix direction, and hence, cleaning non-uniformity may occur in the generatrix direction.

In order to achieve the above requirements for electrical resistance, appropriate adjustment may be made to the mixing proportion of the thermoplastic resin, conductive filler and polyhydric alcohol type nonionic surface-active agent in the thermoplastic resin composition, their compatibility, conditions required when the conductive filler is dispersed, and also conditions required when the electrophotographic conductive member is produced.

Incidentally, the volume resistivity and the surface resistivity show not a mere difference in measuring conditions, but quite different electrical properties.

More specifically, where voltage and electrical current are applied in the thickness direction of the electrophotographic conductive member, the movement of electric charges inside the electrophotographic conductive member depends on the internal structure or physical properties of the electrophotographic conductive member, i.e., the layer configuration of the electrophotographic conductive member and the types, or the state of dispersion, of various additives (such as a resistance control agent). As the result, the surface potential and charge elimination speed of the electrophotographic conductive member are determined.

On the other hand, where voltage and electrical current are applied in such a way that electric charges are delivered and received only at the surface of the electrophotographic conductive member, the surface potential and charge elimination speed are determined by the proportion of the additives (such as a resistance control agent) present at the surface of the electrophotographic conductive member, almost without depending on the internal structure or layer configuration of the electrophotographic conductive member.

A method of measuring the volume resistivity and surface resistivity of the electrophotographic conductive member in the present invention is described below in the case of a transfer material transporting belt.

—Measuring Machine—

Resistance meter: Ultra-high resistance meter R8340A (manufactured by Advantest Corporation).

Sample box: Sample box TR42 for ultra-high resistance meter (manufactured by Advantest Corporation).

The main electrode is 25 mm in diameter, and the guard-ring electrode is 41 mm in inner diameter and 49 mm in outer diameter.

—Sample—

The transfer material transporting belt is cut in a circular form of 56 mm in diameter. After cutting, it is provided, on its one side, with an electrode over the whole surface by forming a Pt—Pd deposited film and, on the other side, provided with a main electrode of 25 mm in diameter and a guard electrode of 38 mm in inner diameter and 50 mm in outer diameter by forming Pt—Pd deposited films. The Pt—Pd deposited films are formed by carrying out vacuum deposition for 2 minutes using Mild Sputter E1030 (manufactured by Hitachi Ltd.). The one on which the vacuum deposition has been carried out is used as the sample.

—Measurement Conditions—

Measurement atmosphere: 23° C., 55% RH.

Here, the measuring sample is previously kept in an environment of 23° C./55% RH for 12 hours or more.

Measurement mode: Discharge for 10 seconds, and charge and measurement for 30 seconds.

Applied voltage: 100 V.

As the applied voltage, employed is 100 V in 1 to 1,000 V, which is the range of the voltage to be applied to the electrophotographic conductive member in the electrophotographic apparatus.

Figure 7:
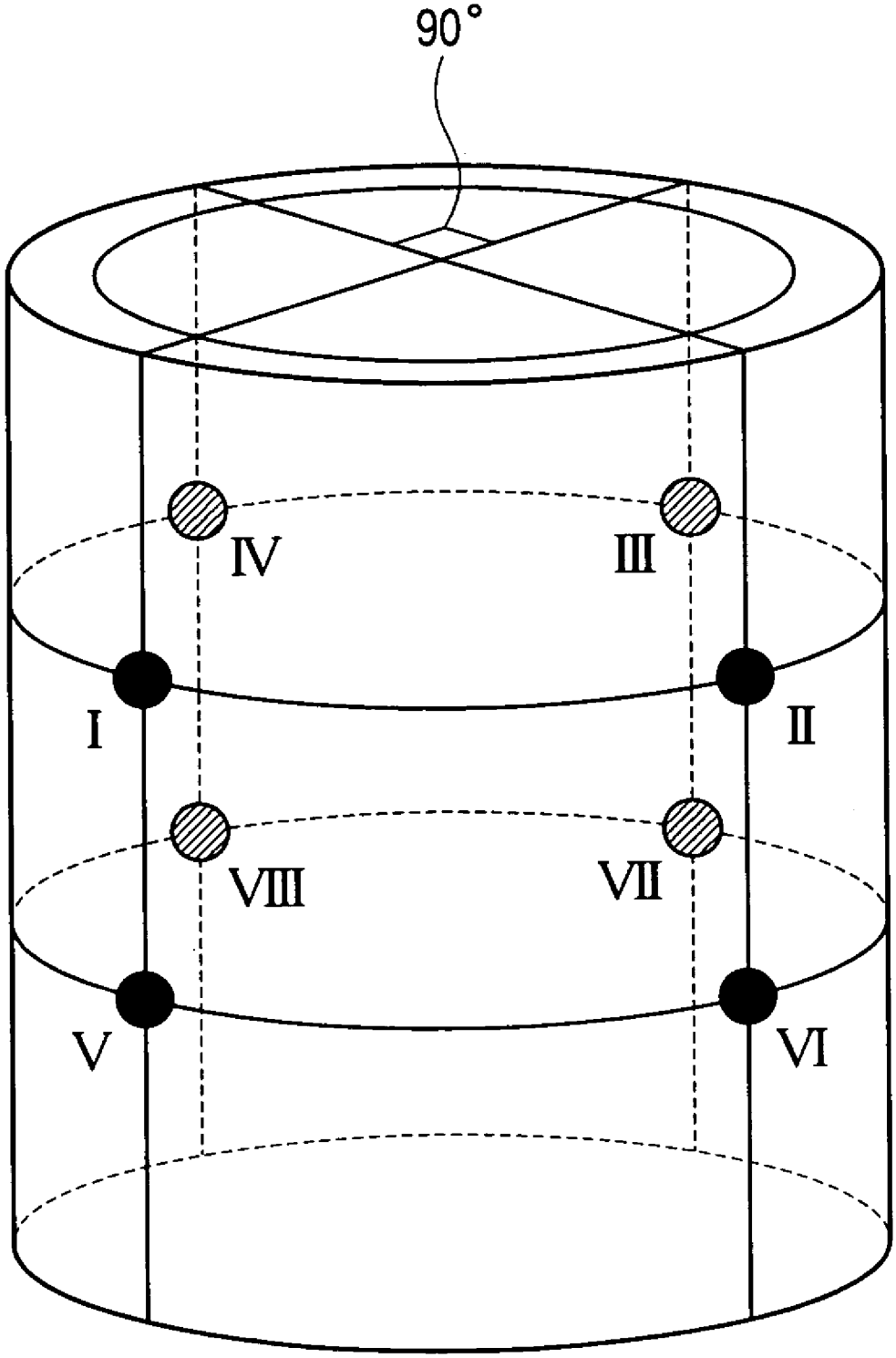
FIG. 7 is a view showing spots at which volume resistivity and surface resistivity are measured.

Measurement spots are four spots in the peripheral direction x and two spots in the axial direction, eight spots in total. Average values of the measurements at the eight spots are regarded as the volume resistivity and surface resistivity of the electrophotographic conductive member (see FIG. 7).

The volume resistivity and surface resistivity of electrophotographic conductive members other than the transfer material transporting belt are also measured in the same manner as the above.

An example of a process for producing the electrophotographic conductive member of the present invention is described in the case of a belt-shaped electrophotographic conductive member.

The process for producing the belt-shaped electrophotographic conductive member may include, e.g., extrusion, blown-film extrusion (inflation), injection molding, and blow molding. In particular, blown-film extrusion is preferred.

FIG. 1 is a schematic view showing an example of the construction of an apparatus for producing the belt-shaped electrophotographic conductive member, which employs blown-film extrusion.

First, an extrusion material prepared by premixing the above thermoplastic resin, conductive filler and polyhydric alcohol type nonionic surface-active agent in the stated formulation, followed by kneading and dispersion, is put into an extruder 101 from a hopper 102. Temperature and screw construction in the extruder 101 are selected so that the extrusion material has a melt viscosity sufficient to be extruded into a belt. Also, the conductive filler is uniformly dispersed in the extrusion material.

The extrusion material is melt-kneaded in the extruder 101 into a melt, which then enters a circular die 103. The circular die 103 is provided with a gas inlet passage 104. Through the gas inlet passage 104, gas 105, such as air, is blown into the circular die 103, whereupon the melt having passed through the circular die 103 inflates while diametrically increasing in size. Incidentally, the extrusion may be carried out without blowing the gas 105 into the gas inlet passage 104.

The extruded product 106 having thus inflated is drawn upward by means of a pinch roller 108 while being cooled by a cooling ring (not shown). When the extruded product 106 is drawn upward, it passes through the space defined by a dimension stabilizing guide 107, whereby the length in the peripheral direction (peripheral length) of the belt is fixed. Also, the extruded product 106 is cut with a cutter 109 in a desired length, whereby the length in the generatrix direction (width) of the belt is fixed.

Thus, the belt-shaped electrophotographic conductive member can be obtained. This process is called blown-film extrusion (inflation method).

Figure 2:
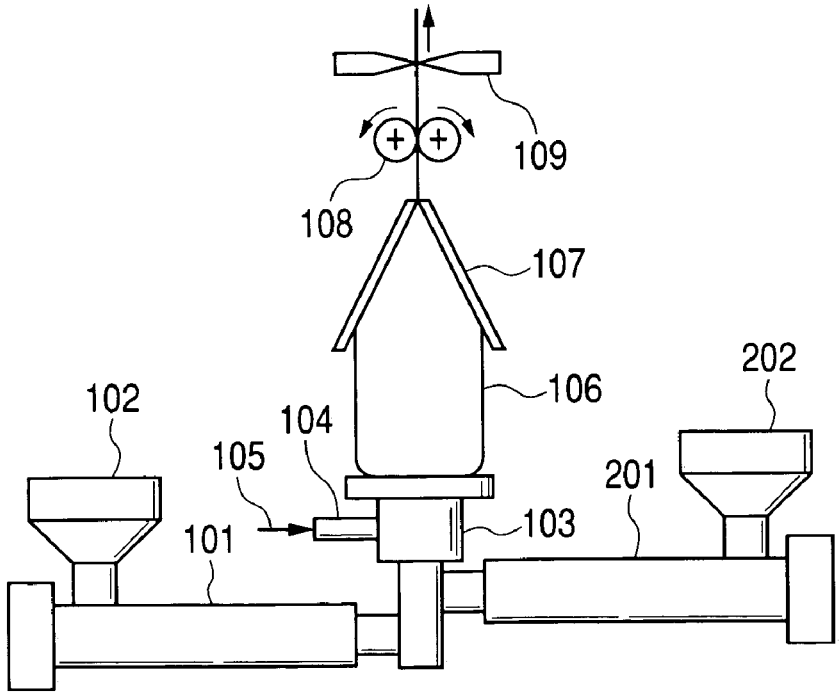
FIG. 2 is a schematic view showing another example of the construction of an apparatus for producing an electrophotographic endless belt, which employs a blown-film extrusion (inflation) method.

The foregoing description relates to the production of a belt of a single-layer construction. In the case of a belt of a double-layer construction, a second extruder 201 is additionally provided, as shown in FIG. 2 (202 denotes a second hopper). A melt from the extruder 101 and a melt from the extruder 201 are simultaneously sent into a circular die 103, and the two layers are scale-up inflated simultaneously. Thus, the belt with a double-layer construction can be obtained. In the case of a triple- or more layer construction, the number of extruders may be provided to correspond to the number of layers.

In the case when the electrophotographic conductive member of the present invention has the shape of a belt, the belt may preferably have a thickness of from 45 μm to 300 μm, more preferably from 50 μm to 270 μm, and still more preferably from 55 μm to 260 μm. If the belt is too thick, it may have a poor belt travel performance because of high rigidity and poor flexibility, resulting in deflection or one-sided travel. If, on the other hand, the belt is too thin, it may have low tensile strength or may stretch as a result of long-term service.

Incidentally, in the above blown-film extrusion, the extrusion material is obtained beforehand and then extruded in the shape of a belt. However, it may be extruded in the shape of a belt in one step.

Next, as a method for producing a roller-shaped electrophotographic conductive member, in particular, an electrophotographic conductive member having a shape in which a roller-shaped support (mandrel) is covered thereon with the thermoplastic resin composition, which has been made in a tubular form, the following methods are available.

These are a method in which materials, such as the thermoplastic resin, the conductive filler and the polyhydric alcohol type nonionic surface-active agent, are kneaded by means of an open roll or a closed mixer, such as a kneader or Banbury mixer, or a twin-screw extruder, and thereafter extruded in a tubular form by an extrusion means, such as a single-screw extruder, then the tube obtained is stretched into a tube with a larger inner diameter by utilizing air or vacuum drawing, and the support is press-inserted to the tube to effect fitting; and a method in which, utilizing heat-shrinkable properties of the one extruded in the shape of a tube, the tube is fitted to the roller-shaped support on the inside of which the tube is kept inserted.

In these methods, the materials having been made plastic by heat are passed through between the die and a nipple and thereby extruded in the shape of a tube. The inner-surface roughness of the tube may be adjusted by controlling processing temperature, extrusion speed, rate of pulling, and so forth. It may also be adjusted by providing the die and the nipple with stated shapes.

Figure 3:
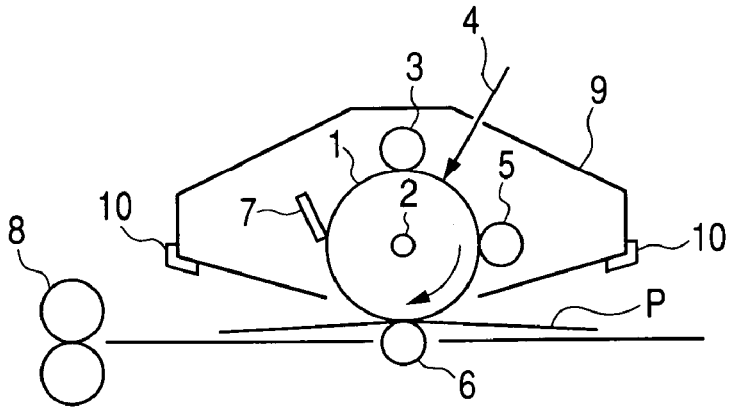
FIG. 3 is a schematic view showing an example of the construction of an electrophotographic apparatus.

FIG. 3 schematically illustrates the construction of an electrophotographic apparatus.

In FIG. 3, reference numeral 1 denotes a cylindrical electrophotographic photosensitive member, which is rotatingly driven around an axis 2 in the direction of an arrow at a stated peripheral speed.

The surface of the electrophotographic photosensitive member 1 driven rotatingly is uniformly electrostatically charged to a positive or negative given potential through a primary charging means 3. The electrophotographic photosensitive member thus charged is then exposed to exposure light (image-wise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer held on a developer carrying member 5, to form toner images (developed images; the same applies hereinafter). Then, the toner images thus formed and held on the surface of the electrophotographic photosensitive member 1 are successively transferred by applying a transfer bias from a transfer charging member 6 to a transfer material (such as paper) P fed from a transfer material feed means (not shown) to the part (contact zone) between the electrophotographic photosensitive member 1 and the transfer charging member 6 in the manner synchronized with the rotation of the electrophotographic photosensitive member 1.

The transfer material P to which the toner images have been transferred is separated from the surface of the electrophotographic photosensitive member 1, is guided into a fixing means 8, where the toner images are fixed, and is then put out of the apparatus as an image-formed material (a print-out or a copy).

The surface of the electrophotographic photosensitive member 1 from which the toner images have been transferred is brought so that the transfer residual developer (toner) can be removed by a cleaning member (cleaning blade) 7. Thus, its surface is cleaned. It is further subjected to charge elimination by pre-exposure light (not shown) emitted from a pre-exposure means (not shown), and thereafter, repeatedly used for the formation of images. Incidentally, where, as shown in FIG. 3, contact charging using a roller-shaped primary charging member (primary charging roller) or the like is employed in the charging of the surface of the electrophotographic photosensitive member, the pre-exposure is not necessarily required.

The apparatus may be constituted of a combination of plural components integrally joined in a container as a process cartridge from among the constituents, such as the above electrophotographic photosensitive member 1, primary charging member 3, developer carrying member 5, transfer charging member 6 and cleaning member 7, so that the process cartridge is detachably mountable to the main body of an electrophotographic apparatus, such as a copying machine or a laser beam printer. In the apparatus shown in FIG. 3, the electrophotographic photosensitive member 1 and the primary charging member 3, developer carrying member 5 and cleaning member 7 are integrally supported and made into a cartridge to form a process cartridge 9 that is detachably mountable on the main body of the electrophotographic apparatus through a guide means 10, such as rails, provided in the main body of the electrophotographic apparatus.

As examples of color electrophotographic apparatuses, a color electrophotographic apparatus of an intermediate transfer system and a color electrophotographic apparatus of an in-line system are described next. Incidentally, an example of four colors (yellow, magenta, cyan and black) is used in the following description. The "color" referred to in the present invention is by no means limited to these four colors (what is called full-color), and refers to multiple colors, i.e., two or more colors.

Figure 4:
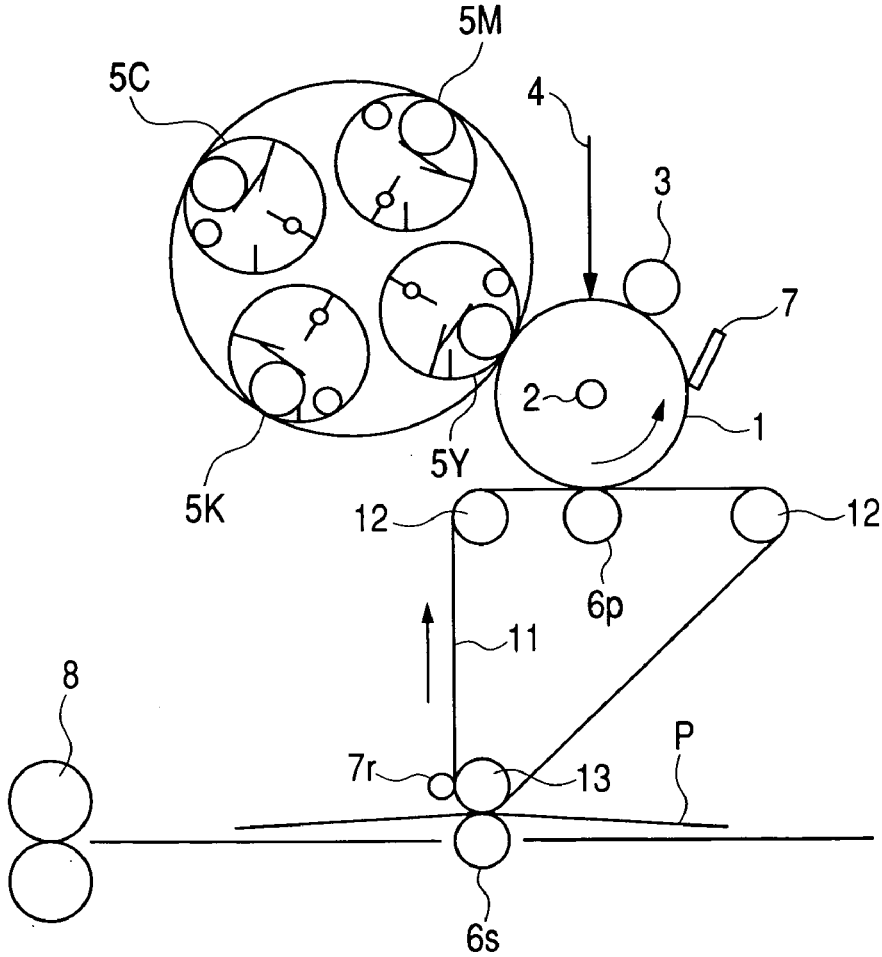
FIG. 4 is a schematic view showing an example of the construction of an intermediate transfer type color electrophotographic apparatus.

FIG. 4 schematically illustrates an example of the construction of a color electrophotographic apparatus of an intermediate transfer system. The transfer of toner images from an electrophotographic photosensitive member to a transfer material is chiefly performed by a primary transfer charging member, an intermediate transfer member and a secondary transfer charging member.

In FIG. 4, reference numeral 1 denotes a cylindrical electrophotographic photosensitive member, which is rotatingly driven around an axis 2 in the direction of an arrow at a prescribed peripheral speed.

The surface of the electrophotographic photosensitive member 1 driven rotatingly is uniformly electrostatically charged on its surface to a positive or negative stated potential through a primary charging member 3. The photosensitive member thus charged is then exposed to exposure light (image-wise exposure light) 4 emitted from an exposure means (not shown) for slit exposure or laser beam scanning exposure. The exposure light used here is exposure light corresponding to a first-color-component image (e.g., a yellow-component image) of an intended color image. Thus, on the surface of the electrophotographic photosensitive member 1, first-color-component electrostatic latent images (yellow-color-component electrostatic latent image) are successively formed, which correspond to the first-color-component image of the intended color image.

An intermediate transfer member (intermediate transfer belt) 11 stretched over stretch-over rollers 12 and a secondary-transfer opposing roller 13 is rotatingly driven in the direction of an arrow at substantially the same peripheral speed as the electrophotographic photosensitive member 1 (e.g., at a speed of 97 to 103% with respect to the peripheral speed of the electrophotographic photosensitive member 1).

The first-color-component electrostatic latent images formed on the surface of the electrophotographic photosensitive member 1 are developed with a first-color toner (yellow toner) contained in a developer held by a first-color developer carrying member (yellow developer carrying member) 5Y to form a first-color toner image (yellow toner image). Then, the first-color toner images formed and held on the surface of the electrophotographic photosensitive member 1 are successively primarily transferred onto the surface of the intermediate transfer member 11 passing through between the electrophotographic photosensitive member 1 and a primary transfer charging member (primary transfer charging roller) 6*p* by the aid of a primary transfer bias applied from the primary transfer charging member 6*p*.

The surface of the electrophotographic photosensitive member 1 from which the first-color toner images have been transferred is cleaned by a cleaning member 7 to remove the primary transfer residual developer (toner) and clean the surface. Thereafter, the photosensitive member thus cleaned is used for the next-color image formation.

Second-color toner images (magenta toner images), third-color toner images (cyan toner images) and fourth-color toner images (black toner images) are formed on the surface of the electrophotographic photosensitive member 1 and then sequentially primarily transferred to the surface of the intermediate transfer member 11 in the same manner as the first-color toner images. Thus, synthesized toner images corresponding to the intended color image are formed on the surface of the intermediate transfer member 11. In the course of the first-color to fourth-color primary transfer, a secondary transfer charging member (secondary transfer charging roller) 6*s* and a charge-providing member (charge-providing roller) 7*r* stand separate from the surface of the intermediate transfer member 11.

The synthesized toner images formed on the surface of the intermediate transfer member 11 are successively secondarily transferred on to a transfer material (such as paper) P by the aid of a secondary transfer bias applied from the secondary transfer charging member 6*s*; the transfer material P being taken out and fed from a transfer material feeding means (not shown) to the part (contact zone) between the secondary-transfer opposing roller 13/intermediate transfer member 11 and the secondary transfer member 6*s* in the manner synchronized with the rotation of the intermediate transfer member 11.

The transfer material P to which the synthesized toner images have been transferred is separated from the surface of the intermediate transfer member 11 and guided into a fixing means 8, where the synthesized toner images are fixed, and is then put out of the apparatus as a color image-formed matter (a print-out or a copy).

The charge-providing member 7*r* is brought into contact with the surface of the intermediate transfer member 11 from which the synthesized toner images have been transferred. The charge-providing member 7*r* provides the secondary transfer residual developers (toners) held on the surface of the intermediate transfer member 11, with electric charges having a polarity reverse to that at the time of the primary transfer. The secondary transfer residual developers (toners) having been provided with electric charges with the polarity opposite of that at the time of the primary transfer are electrostatically transferred to the surface of the electrophotographic photosensitive member 1 at the contact zone between the electrophotographic photosensitive member 1 and the intermediate transfer member 11 and the vicinity thereof. Thus, the surface of the intermediate transfer member 11 from which the synthesized toner images have been transferred is cleaned by the removal of the secondary transfer residual developers (toners). The secondary transfer residual developers (toners) having been transferred to the surface of the electrophotographic photosensitive member 1 are removed by the cleaning member 7 together with the primary transfer residual developers (toners) held on the surface of the electrophotographic photosensitive member 1. The transfer of the secondary transfer residual developers (toners) from the intermediate transfer member 11 to the electrophotographic photosensitive member 1 can be performed simultaneously with the primary transfer, and hence, the through-put does not decrease.

The surface of the electrophotographic photosensitive member 1 from which the transfer residual developers (toners) have been removed by the cleaning member 7 may also be subjected to charge elimination by pre-exposure light emitted from a pre-exposure means. However, where, as shown in FIG. 4, contact charging using a roller-shaped primary charging member (primary charging roller) or the like is employed in the charging of the surface of the electrophotographic photosensitive member, the pre-exposure is not necessarily required.

Figure 5:
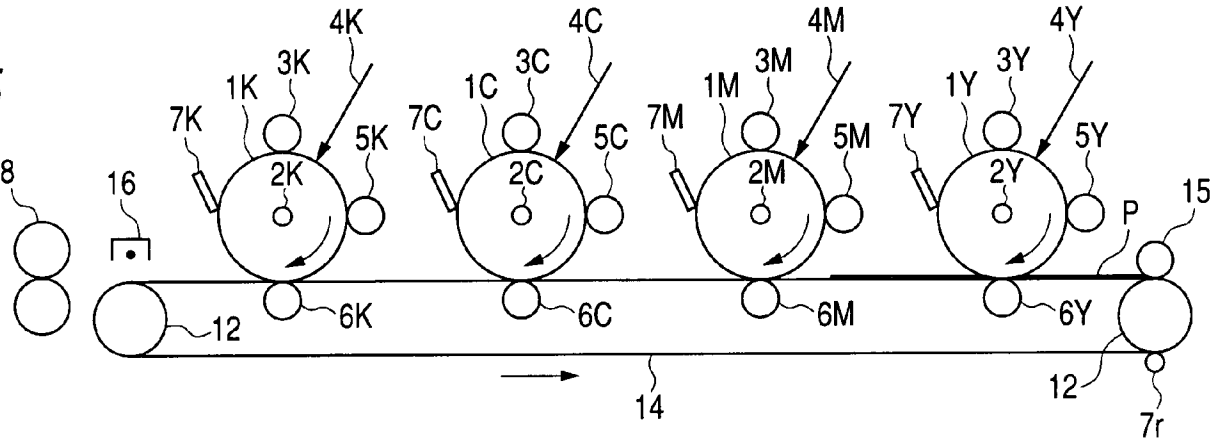
FIG. 5 is a schematic view showing an example of the construction of an in-line type color electrophotographic apparatus.

FIG. 5 schematically illustrates an example of the construction of a color electrophotographic apparatus of an in-line system. In the case of this in-line system, the transfer of toner images from an electrophotographic photosensitive member to a transfer material is chiefly performed by a transfer material transport member and a transfer charging member.

In FIG. 5, reference numerals 1Y, 1M, 1C and 1K denote cylindrical electrophotographic photosensitive members (electrophotographic photosensitive members for the first color to the fourth color), which are rotatingly driven around axes 2Y, 2M, 2C and 2K, respectively, in the directions of arrows, each at a stated peripheral speed.

The surface of the electrophotographic photosensitive member 1Y for the first color, which is rotatingly driven, is uniformly electrostatically charged to a positive or negative given potential through a primary charging member 3Y for the first color. The electrophotographic photosensitive member thus charged is then exposed to exposure light (image-wise exposure light) 4Y emitted from an exposure means (not shown) for slit exposure, laser beam scanning exposure or the like. The exposure light 4Y is an exposure light corresponding to a first-color-component image (e.g., a yellow-component image) of an intended color image. In this way, first-color-component electrostatic latent images (yellow-component electrostatic latent images) corresponding to the first-color-component image of the intended color image are successively formed on the surface of the electrophotographic photosensitive member 1Y.

A transfer material transport member (transfer material transport belt) 14 is stretched over stretch-over rollers 12, which are rotatingly driven in the direction of an arrow at substantially the same peripheral speed as the electrophotographic photosensitive members 1Y, 1M, 1C and 1K for the first color to the fourth color (e.g., 97% to 103% with respect to the peripheral speed of each of the electrophotographic photosensitive members 1Y, 1M, 1C and 1K for the first color to the fourth color). Also, a transfer material (such as paper) P fed from a transfer material feed means (not shown) is electrostatically held on (attracted to) the transfer material transport member 14 and is successively transported to the parts (contact zones) between the electrophotographic photosensitive members 1Y, 1M, 1C and 1K for the first color to the fourth color and the transfer material transport member 14.

The first-color-component electrostatic latent images thus formed on the surface of the electrophotographic photosensitive member 1Y for first color are developed with a first-color toner contained in a developer held by a developer carrying member 5Y for the first color to form first-color toner images (yellow toner images). Then, the first-color toner images thus formed and held on the surface of the electrophotographic photosensitive member 1Y for the first color are successively transferred by the aid of a transfer bias applied from a transfer charging member 6Y for the first color (transfer charging roller for the first color), and are transferred onto a transfer material P held on the transfer material transport member 14, which passes through between the electrophotographic photosensitive member 1Y for the first color and the transfer charging member 6Y for the first color.

The surface of the electrophotographic photosensitive member 1Y for the first color from which the first-color toner images have been transferred is brought to have the transfer residual developer (toner) removed by a cleaning member 7Y for the first color (cleaning blade for the first color). Thus, the surface is cleaned. Thereafter, the electrophotographic photosensitive member 1Y for the first color is repeatedly used for the formation of the first-color toner images.

The electrophotographic photosensitive member 1Y for the first color, the primary charging member 3Y for first color, the exposure means for the first color, the developer carrying member 5Y for the first color and the transfer charging member 6Y for the first color are collectively called an image forming section for the first color.

An image forming section for the second color, which has an electrophotographic photosensitive member 1M for the second color, a primary charging member 3M for the second color, an exposure means for the second color, a developer carrying member 5M for the second color and a transfer charging member 6M for the second color, an image forming section for the third color, which has an electrophotographic photosensitive member 1C for the third color, a primary charging member 3C for the third color, an exposure means for the third color, a developer carrying member 5C for the third color and a transfer charging member 6C for the third color, and an image forming section for the fourth color, which has an electrophotographic photosensitive member 1K for the fourth color, a primary charging member 3K for the fourth color, an exposure means for the fourth color, a developer carrying member 5K for the fourth color and a transfer charging member 6K for fourth color are operated in the same way as the operation of the image forming section for the first color. Thus, second-color toner images (magenta toner images), third-color toner images (cyan toner images) and fourth-color toner images (black toner images) are transferred in order to the transfer material P, which is held on the transfer material transport member 14 and to which the first-color toner images have been transferred. In this way, synthesized toner images corresponding to the intended color image are formed on the transfer material P held on the transfer material transport member 14.

The transfer material P on which the synthesized toner images have been formed is separated from the surface of the transfer material transport member 14, is guided into a fixing means 8, where the toner images are fixed, and is then put out of the apparatus as a color-image-formed material (a print-out or a copy).

The surfaces of the electrophotographic photosensitive members 1Y, 1M, 1C and 1K for the first color to the fourth color from which the transfer residual developers (toners) have been removed by the cleaning members 7Y, 7M, 7C and 7K, respectively, may also be subjected to charge elimination by pre-exposure light emitted from pre-exposure means. However, where, as shown in FIG. 5, contact charging using a roller-shaped primary charging member (a primary charging roller) or the like is employed in the charging of the surface of each electrophotographic photosensitive member, the pre-exposure is not necessarily required.

Incidentally, in FIG. 5, reference numeral 15 denotes an attraction roller for attracting the transfer material to the transfer material transport member. Reference number 16 denotes a separation charging assembly for separating the transfer material from the transfer material transport member.

Figure 6:
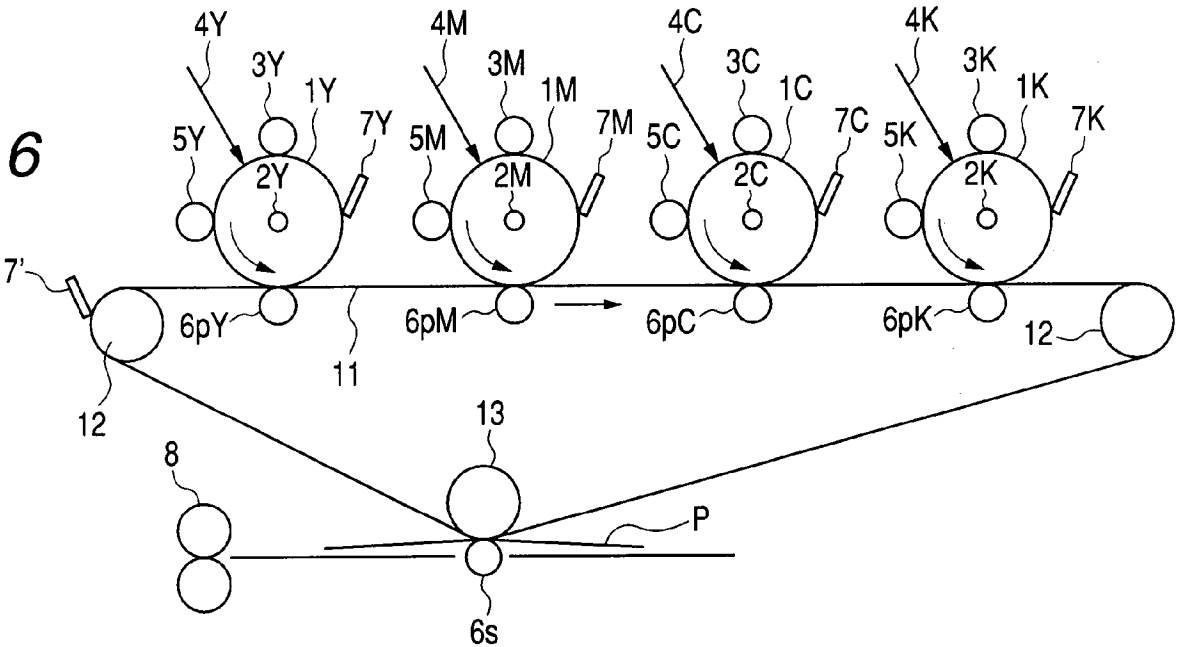
FIG. 6 is a schematic view showing another example of the construction of the intermediate transfer type color electrophotographic apparatus.

FIG. 6 schematically illustrates another example of the construction of a color electrophotographic apparatus of an intermediate transfer system. In the case of this intermediate transfer system, the transfer of toner images from an electrophotographic photosensitive member to a transfer material is chiefly performed by a primary transfer charging member, an intermediate transfer member and a secondary transfer charging member.

In FIG. 6, reference numerals 1Y, 1M, 1C and 1K denote cylindrical electrophotographic photosensitive members (electrophotographic photosensitive members for the first color to the fourth color), which are rotatingly driven around axes 2Y, 2M, 2C and 2K, respectively, in the directions of arrows, each at a stated peripheral speed.

The surface of the electrophotographic photosensitive member 1Y for the first color, which is rotatingly driven, is uniformly electrostatically charged to a positive or negative given potential through a primary charging member 3Y for the first color. The electrophotographic photosensitive member thus charged is then exposed to exposure light (image-wise exposure light) 4Y emitted from an exposure means (not shown) for slit exposure, laser beam scanning exposure or the like. The exposure light 4Y is an exposure light corresponding to a first-color-component image (e.g., a yellow-component image) of an intended color image. In this way, first-color-component electrostatic latent images (yellow-component electrostatic latent images) corresponding to the first-color-component image of the intended color image are successively formed on the surface of the electrophotographic photosensitive member 1Y.

An intermediate transfer member (intermediate transfer belt) 11 is stretched over stretch-over rollers 12 and a secondary-transfer opposing roller 13, which are rotatingly driven in the direction of an arrow at substantially the same peripheral speed as the electrophotographic photosensitive members 1Y, 1M, 1C and 1K for the first color to the fourth color (e.g., 97% to 103% with respect to the peripheral speed of each of the electrophotographic photosensitive members 1Y, 1M, 1C and 1K for the first color to the fourth color).

The first-color-component electrostatic latent images thus formed on the surface of the electrophotographic photosensitive member 1Y for first color are developed with a first-color toner contained in a developer held on a developer carrying member 5Y for the first color to form first-color toner images (yellow toner images). Then, the first-color toner images thus formed and held on the surface of the electrophotographic photosensitive member 1Y for the first color are successively primarily transferred by the aid of a primary transfer bias applied from a primary transfer charging member 6*p*Y for the first color (primary transfer charging roller for first color), which are transferred onto the surface of the intermediate transfer member 11, which passes the part between the electrophotographic photosensitive member 1Y for first color and the primary transfer member 6*p*Y for first color.

The surface of the electrophotographic photosensitive member 1Y for the first color from which the first-color toner images have been transferred is brought to have the transfer residual developer (toner) removed by a cleaning member 7Y for the first color (cleaning blade for the first color). Thus, the surface is cleaned. Thereafter, the electrophotographic photosensitive member 1Y for the first color is repeatedly used for the formation of the first-color toner images.

The electrophotographic photosensitive member 1Y for the first color, the primary charging member 3Y for the first color, the exposure means for the first color, the developer carrying member 5Y for the first color and the primary transfer charging member 6*p*Y for the first color are collectively called an image forming section for the first color.

An image forming section for second color which has an electrophotographic photosensitive member 1M for the second color, a primary charging member 3M for the second color, an exposure means for the second color, a developer carrying member 5M for the second color and a primary transfer charging member 6*p*M for the second color, an image forming section for the third color, which has an electrophotographic photosensitive member 1C for the third color, a primary charging member 3C for the third color, an exposure means for the third color, a developer carrying member 5C for third color and a primary transfer charging member 6*p*C for the third color, and an image forming section for the fourth color, which has an electrophotographic photosensitive member 1K for the fourth color, a primary charging member 3K for the fourth color, an exposure means for the fourth color, a developer carrying member 5K for the fourth color and a primary transfer charging member 6*p*K for the fourth color are operated in the same way as the operation of the image forming section for the first color. Thus, second-color toner images (magenta toner images), third-color toner images (cyan toner images) and fourth-color toner images (black toner images) are transferred in order to the surface of the intermediate transfer member 11. In this way, synthesized toner images corresponding to the intended color image are formed on the surface of the intermediate transfer member 11.

The synthesized toner images formed on the surface of the intermediate transfer member 11 are successively secondarily transferred on to a transfer material (such as paper) P by the aid of a secondary transfer bias applied from a secondary transfer charging member 6*s*; the transfer material P being taken out and fed from a transfer material feeding means (not shown) to the part (contact zone) between the secondary transfer opposing roller 13/intermediate transfer member 11 and the secondary transfer member 6*s* in the manner synchronized with the rotation of the intermediate transfer member 11.

The transfer material P to which the synthesized toner images have been transferred is separated from the surface of the intermediate transfer member 11, is guided into a fixing means 8, where the toner images are fixed, and is then put out of the apparatus as a color-image-formed material (a print-out or a copy).

The surface of the intermediate transfer member 11 from which the synthesized toner images have been transferred is brought to have secondary transfer residual developers (toners) removed by an intermediate transfer member cleaning member 7'. Thus, its surface is cleaned. Thereafter, it is repeatedly used for the formation of the next synthesized toner images.

The surfaces of the electrophotographic photosensitive members 1Y, 1M, 1C and 1K for the first color to the fourth color from which the transfer residual developers (toners) have been removed by the cleaning members 7Y, 7M, 7C and 7K, respectively, may also be subjected to charge elimination by pre-exposure light emitted from pre-exposure means. However, where, as shown in FIG. 6, contact charging using a roller-shaped primary charging member (a primary charging roller) or the like is employed in the charging of the surface of each electrophotographic photosensitive member, the pre-exposure is not necessarily required.

The electrophotographic conductive member of the present invention may preferably be used in the above primary charging member, developer carrying member, transfer charging member, primary transfer charging member, intermediate transfer member, secondary transfer charging member, charge-providing member and transfer material transporting member, and the like.

Incidentally, the developing system may preferably be a one-component developing system, and may also preferably be a contact developing system.

The present invention is described below in greater details by providing specific working examples. Note that the present invention is by no means limited to these working examples. In the following Examples, "part(s)" refers to "part(s) by weight".

Example 1

As materials for the thermoplastic resin composition, the following ones were used.

| | |
|---|---|
| Thermoplastic resin: | |
| Polyamide 12<br>(melt viscosity: MFR = 10) | 100 parts |
| Conductive filler: | |
| Conductive carbon black (1)<br>(trade name: DENKA BLACK granular product, available from Denki Kagaku Kogyo Kabushiki Kaisha) | 15.5 parts |
| Polyhydric alcohol type nonionic surface-active agent: | |
| Polyglycerol poly-ricinolate<br>(trade name: CHIRABAZOL H-801, available from Taiyo Kagaku Co., Ltd.) | 0.5 part |

The conductive carbon black (1) and the polyglycerol poly-ricinolate were mixed by means of Henschel mixer, and thereafter, the polyamide 12 was added and mixed. The obtained mixture was kneaded using a twin-screw extruder, and this was further made into a kneaded product in the form of a 2 to 3 mm particle in diameter to obtain an extrusion material.

Next, the extrusion material was introduced into the extruder 101 form the hopper 102 of the apparatus set up as shown in FIG. 1, and then extruded controlling its setting temperature within the range of from 200 to 220° C., to obtain a belt. Its size was adjusted to obtain a belt-shaped electrophotographic conductive member of 160 mm in peripheral length, 230 mm in width and 150 μm in thickness.

The belt-shaped electrophotographic conductive member obtained had a volume resistivity of $1.5\times10^{9}$ Ω·cm and a surface resistivity of $4.5\times10^{9}$Ω. Also, in both the volume resistivity and the surface resistivity, their maximum values were within 10 times the minimum values in both the peripheral direction and the generatrix direction.

A voltage of 500 V was applied to the belt-shaped electrophotographic conductive member obtained, and no leaks occurred.

The belt-shaped electrophotographic conductive member obtained was visually observed. As the result, neither foreign matter, such as protrusions or fish eyes, nor any sign of faulty extrusion was seen on the surface. This is considered to have resulted from the fact that the polyhydric alcohol type nonionic surface-active agent increased the dispersion effect so that the conductive filler did not agglomerate.

The belt-shaped electrophotographic conductive member obtained was set as an intermediate transfer belt in the electrophotographic apparatus set up as shown in FIG. 4, and a full-color image reproduction test was conducted in an environment of 15° C./10% RH. As the result, there were observed no image density non-uniformity due to resistance non-uniformity of the intermediate transfer belt from the start, no blank areas caused by a poor transfer due to leaks or the like, and no faulty cleaning. Thus, good images were obtainable. Further, a 10,000-sheet running test was conducted, where the intermediate transfer belt maintained the same surface properties as those at the initial stage without causing any filming of toner on its surface. Here, an elastic roller having a surface resistivity of $1\times10^{8}\Omega$ was used as the charge-providing member.

Using the electrophotographic apparatus set up as shown in FIG. 4, a belt-shaped electrophotographic conductive member also produced in the same manner as discussed above was brought into contact with the electrophotographic photosensitive member, and these were left for a month in an environment of 40° C./95% RH. Thereafter, the electrophotographic photosensitive member was visually observed. As a result, the surface of the electrophotographic photosensitive member was seen not to have been contaminated. Thereafter, image reproduction was tested. As a result, no faulty images, such as black lines and white areas, were seen at the part corresponding to the one where the belt-shaped electrophotographic conductive member and the electrophotographic photosensitive member were kept in contact. Also, the surface resistivity of the belt-shaped electrophotographic conductive member having been left for a month was $3.8\times10^{9}\Omega$, which differed little from the value before contact. Thus, the performance of the electrophotographic conductive member was observed not to have changed even when it was left in a severe environment.

Example 2

A belt-shaped electrophotographic conductive member was produced in the same manner as in Example 1, except that the following materials were used as materials for the thermoplastic resin composition.

| | |
|---|---|
| Thermoplastic resin: | |
| Polyamide 12<br>(melt viscosity: MFR = 10) | 100 parts |
| Conductive filler: | |
| Conductive carbon black (2)<br>(trade name: KETJEN BLACK EC600JD, available from Lion Corporation) | 4.5 parts |
| Polyhydric alcohol type nonionic surface-active agent: | |
| Polyglycerol stearate<br>(trade name: CHIRABAZOL P-4, available from Taiyo Kagaku Co., Ltd.) | 0.8 part |

The belt-shaped electrophotographic conductive member obtained had a volume resistivity of $3.4\times10^{9}$ Ω·cm and a surface resistivity of $6.2\times10^{9}\Omega$. Also, in both the volume resistivity and the surface resistivity, their maximum values were within 15 times the minimum values in both the peripheral direction and the generatrix direction.

A voltage of 500 V was applied to the belt-shaped electrophotographic conductive member obtained, and no leaks occurred.

The obtained belt-shaped electrophotographic conductive member was visually observed. As a result, neither foreign matter, such as protrusions or fish eyes, nor any sign of faulty extrusion was seen on the surface. This is considered to be due to the fact that the polyhydric alcohol type nonionic surface-active agent had such a high dispersion effect that no agglomeration of the conductive filler was caused.

The obtained belt-shaped electrophotographic conductive member was set as an intermediate transfer belt in the electrophotographic apparatus set up as shown in FIG. 4, and a full-color image reproduction test was conducted in an environment of 15° C./10% RH. As a result, there were observed no image density non-uniformity due to resistance non-uniformity of the intermediate transfer belt from the start, no blank areas caused by a poor transfer due to leaks or the like, and no faulty cleaning. Thus, good images were obtainable. Further, a 10,000-sheet running test was conducted, where the intermediate transfer belt maintained the same surface properties as those at the initial stage without causing any filming of toner on its surface.

Using the electrophotographic apparatus set up as shown in FIG. 4, a belt-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, the surface of the electrophotographic photosensitive member was seen not to have been contaminated. Then, image reproduction was tested. As a result, no faulty images, such as black lines and white areas, were seen at the part corresponding to the one where the belt-shaped electrophotographic conductive member and the electrophotographic photosensitive member were kept in contact. Also, the surface resistivity of the belt-shaped electrophotographic conductive member having been left for a month was $6.0\times10^{9}\Omega$, which differed little from the value before contact. Thus, the performance of the electrophotographic conductive member was observed not to have changed even when it was left in a severe environment.

Example 3

A belt-shaped electrophotographic conductive member was produced in the same manner as in Example 1, except that the following materials were used as materials for the thermoplastic resin composition and that the belt was formed in a size of 180 mm in peripheral length, 230 mm in width and 150 μm in thickness.

| | |
|---|---|
| Thermoplastic resin: | |
| Polyamide 12<br>(melt viscosity: MFR = 10) | 100 parts |
| Conductive filler: | |
| Conductive carbon black (2)<br>(trade name: KETJEN BLACK EC600JD, available from Lion Corporation) | 4.3 parts |

-continued

| | |
|---|---|
| Polyhydric alcohol type nonionic surface-active agent: | |
| Polyglycerol stearate (trade name: CHIRABAZOL P-4, available from Taiyo Kagaku Co., Ltd.) | 0.8 part |

The belt-shaped electrophotographic conductive member obtained had a volume resistivity of $6.4\times10^{9}$ Ω·cm and a surface resistivity of $8.1\times10^{9}$Ω. Also, in both the volume resistivity and the surface resistivity, their maximum values were within 15 times the minimum values in both the peripheral direction and the generatrix direction.

A voltage of 500 V was applied to the obtained belt-shaped electrophotographic conductive member, and no leaks occurred.

The belt-shaped electrophotographic conductive member obtained was visually observed. As the result, neither foreign matter, such as protrusions or fish eyes, nor any signs of faulty extrusion were observed on the surface. This is considered to be due to the fact that the polyhydric alcohol type nonionic surface-active agent resulted in a sufficiently high dispersion effect so as to cause no agglomerate of the conductive filler.

The belt-shaped electrophotographic conductive member obtained was set as an intermediate transfer belt in the electrophotographic apparatus set up as shown in FIG. 6, and a full-color image reproduction test was conducted in an environment of 15° C./10% RH. As the result, there were observed no image density non-uniformity due to resistance non-uniformity of the intermediate transfer belt from the start, no blank areas caused by poor transfer due to leaks or the like were, and no faulty cleaning. Thus, good images were obtainable. Further, a 10,000-sheet running test was conducted, where the intermediate transfer belt maintained the same surface properties as those at the initial stage without causing any filming of toner on its surface.

Using the electrophotographic apparatus set up as shown in FIG. 6, a belt-shaped electrophotographic conductive member also produced in the same manner as the above was brought into contact with the electrophotographic photosensitive member, and these were left for a month in an environment of 40° C./95% RH, and thereafter the electrophotographic photosensitive member was visually observed. As the result, the surface of the electrophotographic photosensitive member was seen not to have been contaminated. Thereafter, image reproduction was tested. As a result, there were observed no faulty images, such as black lines and white areas, at the part corresponding to that where the belt-shaped electrophotographic conductive member and the electrophotographic photosensitive member were kept in contact. Also, the surface resistivity of the belt-shaped electrophotographic conductive member maintained for a month at the above conditions was $7.5\times10^{9}$Ω, which differed little from the value before contact. Thus, the performance of the electrophotographic conductive member was observed not to have changed even when it was left in a severe environment.

Example 4

A belt-shaped electrophotographic conductive member was produced in the same manner as in Example 1, except that the following materials were used as materials for the thermoplastic resin composition and that the belt was formed in a size of 200 mm in peripheral length, 260 mm in width and 100 μm in thickness.

| | |
|---|---|
| Thermoplastic resin: | |
| Polyamide 12 (melt viscosity: MFR = 10) | 100 parts |
| Conductive filler: | |
| Conductive carbon black (2) (trade name: KETJEN BLACK EC600JD, available from Lion Corporation) | 3.7 parts |
| Polyhydric alcohol type nonionic surface-active agent: | |
| Polyglycerol stearate (trade name: CHIRABAZOL P-4, available from Taiyo Kagaku Co., Ltd.) | 0.7 part |

The belt-shaped electrophotographic conductive member obtained had a volume resistivity of $5.7\times10^{11}$ Ω·cm and a surface resistivity of $7.1\times10^{11}$Ω. Also, in both the volume resistivity and the surface resistivity, their maximum values were within 30 times the minimum values in both the peripheral direction and the generatrix direction.

A voltage of 500 V was applied to the belt-shaped electrophotographic conductive member obtained, and no leak occurred.

The belt-shaped electrophotographic conductive member obtained was visually observed. As the result, neither foreign matter, such as protrusions or fish eyes, nor any signs of faulty extrusion were observed on the surface. This is considered to be due to the fact that the polyhydric alcohol type nonionic surface-active agent had a sufficiently high dispersion effect so as to cause no agglomerate of the conductive filler.

The belt-shaped electrophotographic conductive member obtained was set as a transfer material transporting belt in the electrophotographic apparatus set up as shown in FIG. 5, and a full-color image reproduction test was conducted in an environment of 15° C./10% RH. As a result, there were observed no image density non-uniformity due to resistance non-uniformity of the transfer material transporting belt from the start, no blank areas caused by poor transfer due to leaks or the like, and no faulty cleaning. Thus, good images were obtainable. Further, a 10,000-sheet running test was conducted, where the transfer material transporting belt maintained the same surface properties as those at the initial stage without causing any filming of toner on its surface.

Using the electrophotographic apparatus set up as shown in FIG. 5, a belt-shaped electrophotographic conductive member also produced in the same manner as the above was brought into contact with the electrophotographic photosensitive member, and these were left for a month in an environment of 40° C./95% RH, and thereafter the electrophotographic photosensitive member was visually observed. As a result, the surface of the electrophotographic photosensitive member was observed not to have been contaminated. Thereafter, image reproduction was tested. As a result, no faulty images, such as black lines and white areas, were observed at the part corresponding to the that where the belt-shaped electrophotographic conductive member and the electrophotographic photosensitive member were kept in contact. Also, the surface resistivity of the belt-shaped electrophotographic conductive member that were left at the above conditions for a month was $5.9\times10^{11}$Ω, which differed little from the value before contact. Thus, the performance of the electrophotographic conductive member was observed not to have changed even when it was left in a severe environment.

Example 5

To 100 parts of silicone rubber, 15 parts of conductive carbon black, 20 parts of dimethylsilicone oil, 6 parts of a blowing agent (AIBN, 2,2'-azobisisobutyronitrile) and 3 parts of a cross-linking agent (benzoyl peroxide) were added, and the mixture obtained was kneaded to prepare a conductive rubber compound.

Using this conductive rubber compound, vulcanization blowing molding was carried out on the periphery of a stainless steel cylinder (support) of 332 mm in length and 6 mm in diameter. Thereafter, the outer periphery of the product obtained was abraded to produce a conductive rubber roller of 14 mm in outer diameter, 4.0 mm in thickness of a foam and 311 mm in axial-direction length of the foam.

Meanwhile, a seamless tube was produced using the following materials as materials for the thermoplastic resin composition.

| | |
|---|---|
| Thermoplastic resins: | |
| Styrene ethylene butylene elastomer | 75 parts |
| Polypropylene | 25 parts |
| Conductive filler: | |
| Conductive carbon black (1) (trade name: DENKA BLACK granular product, available from Denki Kagaku Kogyo Kabushiki Kaisha) | 17.5 parts |
| Polyhydric alcohol type nonionic surface-active agent: | |
| Polyglycerol poly-ricinolate (trade name: CHIRABAZOL H-818, available from Taiyo Kagaku Co., Ltd.) | 1.0 part |

More specifically, the styrene ethylene butylene elastomer, the polypropylene, the conductive carbon black (1) and the polyglycerol poly-ricinolate were melt-kneaded at 180° C. for 10 minutes by means of a pressure kneader. The kneaded product obtained was cooled and then pelletized. Thereafter, the pelletized product was kneaded using a single-screw extruder to make up a kneaded product in the form of pellets of 2 to 3 mm in particle diameter to obtain an extrusion material.

Next, from this extrusion material, a seamless tube of 13.6 mm in inner diameter and 230 μm in thickness was produced using a single-screw extruder set at 170° C.

Air was blown to the inside of the above seamless tube to stretch it into a tube with a larger inner diameter of 14.5 mm. Thereafter, the above conductive rubber roller was inserted thereinto to effect fitting to obtain a roller-shaped electrophotographic conductive member of 14 mm in diameter.

The roller-shaped electrophotographic conductive member obtained had a volume resistivity of $8.5\times10^6$ Ω·cm and a surface resistivity of $3.3\times10^7$Ω. Also, in both the volume resistivity and the surface resistivity, their maximum values were within 10 times the minimum values in both the peripheral direction and the generatrix direction.

A voltage of 500 V was applied to the roller-shaped electrophotographic conductive member obtained, and no leaks occurred.

The roller-shaped electrophotographic conductive member obtained was visually observed. As a result, neither foreign matter, such as protrusions or fish eyes, nor any signs of faulty extrusion were seen on the surface. This is considered to be due to the fact that the polyhydric alcohol type nonionic surface-active agent resulted in a sufficiently high dispersion effect so as to cause no agglomerate of the conductive filler.

The roller-shaped electrophotographic conductive member obtained was set as a primary charging roller in the electrophotographic apparatus set up as shown in FIG. 3, and an image reproduction test was conducted in an environment of 15° C./10% RH. As a result, no image density non-uniformity due to resistance non-uniformity of the primary charging roller was observed from the start, and good images were obtainable. Here, bias voltage was applied to the primary charging roller under the conditions of a peak-to-peak voltage of 2.3 kV, a frequency of 400 Hz and a DC voltage of −700 V.

Using the process cartridge of the electrophotographic apparatus set up as shown in FIG. 3, a roller-shaped electrophotographic conductive member also produced in the same manner as discussed above was brought into contact with the electrophotographic photosensitive member, and these were left for a month in an environment of 40° C./95% RH, and thereafter the electrophotographic photosensitive member was visually observed. As a result, the surface of the electrophotographic photosensitive member was seen not to have been contaminated. Thereafter, image reproduction was tested. As a result, no faulty images, such as black lines and white areas, were seen at the part corresponding to that where the roller-shaped electrophotographic conductive member and the electrophotographic photosensitive member were kept in contact. Also, the surface resistivity of the roller-shaped electrophotographic conductive that left under the environmental conditions discussed above for a month was $1.8\times10^7$Ω, which differed little from the value before contact. Thus, the performance of the electrophotographic conductive member was observed not to have changed even when it was left in a severe environment.

Example 6

A seamless tube was produced in the same manner as in Example 5, except that the following materials were used as materials for the thermoplastic resin composition. A roller-shaped electrophotographic conductive member was also produced in the same manner as in Example 5.

| | |
|---|---|
| Thermoplastic resins: | |
| Styrene ethylene butylene elastomer | 75 parts |
| Polypropylene | 25 parts |
| Conductive filler: | |
| Conductive carbon black (1) (trade name: DENKA BLACK granular product, available from Denki Kagaku Kogyo Kabushiki Kaisha) | 17.5 parts |
| Polyhydric alcohol type nonionic surface-active agent: | |
| Polyglycerol stearate (trade name: CHIRABAZOL P-4, available from Taiyo Kagaku Co., Ltd.) | 2.0 parts |

The roller-shaped electrophotographic conductive member obtained had a volume resistivity of $9.1\times10^6$ Ω·cm and a surface resistivity of $4.8\times10^7$Ω. Also, in both the volume resistivity and the surface resistivity, their maximum values were within 20 times the minimum values in both the peripheral direction and the generatrix direction.

A voltage of 500 V was applied to the roller-shaped electrophotographic conductive member obtained, and no leaks occurred.

The roller-shaped electrophotographic conductive member obtained was visually observed. As a result, neither foreign matter, such as protrusions or fish eyes, nor any sign of faulty extrusion were seen on the surface. This is considered to be due to the fact that the polyhydric alcohol type nonionic surface-active agent resulted in a sufficiently high dispersion effect so as to cause no agglomerate of the conductive filler.

The roller-shaped electrophotographic conductive member obtained was set as a primary charging roller in the electrophotographic apparatus set up as shown in FIG. 3, and an image reproduction test was conducted in an environment of 15° C./10% RH. As a result, no image density non-uniformity due to resistance non-uniformity of the primary charging roller was observed from the start, and good images were obtainable. Here, bias voltage was applied to the primary charging roller under the conditions of a peak-to-peak voltage of 2.3 kV, a frequency of 400 Hz and a DC voltage of −700 V.

Using the process cartridge of the electrophotographic apparatus set up as shown in FIG. 3, a roller-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, the surface of the electrophotographic photosensitive member was seen not to have been contaminated. Thereafter, image reproduction was tested. As a result, no faulty images, such as black lines and white areas, were seen at the part corresponding to that where the roller-shaped electrophotographic conductive member and the electrophotographic photosensitive member were kept in contact. Also, the surface resistivity of the roller-shaped electrophotographic conductive member that was left under the above-discussed environmental conditions for a month was $3.7\times10^{7}\Omega$, which differed little from the value before contact. Thus, the performance of the electrophotographic conductive member was observed not to have changed even when it was left in a severe environment.

Example 7

To acrylic rubber, an additive, such as conductive carbon black, and a vulcanization accelerator were added, and the mixture obtained was kneaded by means of a two-roll mill to produce a conductive rubber compound.

This conductive rubber compound was wound around an iron cylinder (support), which had been coated with a primer on its surface, and this was put into a mold, followed by vulcanization at 170° C. for 25 minutes to produce a semiconductive elastic roller.

Meanwhile, a seamless tube was produced using the following materials as materials for the thermoplastic resin composition.

| Thermoplastic resins: | |
|---|---|
| Polyethylene (melt viscosity: MFR = 2) | 75 parts |
| Polypropylene | 25 parts |

-continued

| Conductive filler: | |
|---|---|
| Conductive carbon black (1) (trade name: DENKA BLACK granular product, available from Denki Kagaku Kogyo Kabushiki Kaisha) | 18.5 parts |
| Polyhydric alcohol type nonionic surface-active agent: | |
| Polyglycerol poly-ricinolate (trade name: CHIRABAZOL H-818, available from Taiyo Kagaku Co., Ltd.) | 1.0 part |
| PMMA (polymethyl methacrylate) particles (average particle diameter: 7.5 μm; true density: 1.19 g/cm3; length/breadth: 1.06) | 10 parts |

More specifically, the polyethylene, the polypropylene, the conductive carbon black (1), the polyglycerol poly-ricinolate and the PMMA particles were melt-kneaded at 180° C. for 10 minutes by means of a pressure kneader. The kneaded product obtained was cooled and then pelletized. Thereafter, the pelletized product was kneaded using a single-screw extruder to make up a kneaded product in the form of 2 to 3 mm in particle diameter to obtain an extrusion material.

Next, from this extrusion material, a seamless tube of 13.6 mm in inner diameter and 230 μm in thickness was produced using a single-screw extruder set at 170° C.

Air was blown to the inside of the above seamless tube to stretch it into a tube with a larger inner diameter of 14.5 mm. Thereafter, the above semiconductive elastic rubber roller was inserted thereinto to effect fitting to obtain a roller-shaped electrophotographic conductive member of 14 mm in diameter.

The roller-shaped electrophotographic conductive member obtained had a volume resistivity of $5.1\times10^{5}$ Ω·cm and a surface resistivity of $9.4\times10^{5}\Omega$. Also, in both the volume resistivity and the surface resistivity, their maximum values were within 10 times the minimum values in both the peripheral direction and the generatrix direction.

A voltage of 500 V was applied to the roller-shaped electrophotographic conductive member obtained, and no leaks occurred.

The roller-shaped electrophotographic conductive member obtained was visually observed. As a result, neither foreign matter, such as protrusions or fish eyes, nor any sign of faulty extrusion were seen on the surface. This is considered to be due to the fact that the polyhydric alcohol type nonionic surface-active agent resulted in a sufficiently high dispersion effect so as to cause no agglomerate of the conductive filler.

The roller-shaped electrophotographic conductive member obtained was set as a developing roller in the electrophotographic apparatus set up as shown in FIG. 4, and a full-color image reproduction test was conducted in an environment of 15° C./10% RH. As a result, no image density non-uniformity due to resistance non-uniformity of the developing roller was seen from the start, and good images were obtainable. Incidentally, as the above roller-shaped electrophotographic conductive member, four members were prepared, and these were used as the four developing rollers of the electrophotographic apparatus set up as shown in FIG. 4.

Using the electrophotographic apparatus set up as shown in FIG. 4, a roller-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, the surface of the electrophotographic photosensitive member was seen not to have been contaminated. Thereafter, image reproduction was tested. As a result, no faulty images, such as black lines and white areas, were seen at the part corresponding to that where the roller-shaped electrophotographic conductive member and the electrophotographic photosensitive member were kept in contact. Also, the surface resistivity of the roller-shaped electrophotographic conductive member having been left for a month under the above-discussed environmental conditions was $8.2\times10^5\Omega$, which differed little from the value before contact. Thus, the performance of the electrophotographic conductive member was observed not to have changed even when it was left in a severe environment.

Example 8

A seamless tube was produced in the same manner as in Example 7, except that the following materials were used as materials for the thermoplastic resin composition. A roller-shaped electrophotographic conductive member was also produced in the same manner as in Example 7.

| | |
|---|---|
| Thermoplastic resins: | |
| Polyethylene (melt viscosity: MFR = 2) | 75 parts |
| Polypropylene | 25 parts |
| Conductive filler: | |
| Conductive carbon black (1) (trade name: DENKA BLACK granular product, available from Denki Kagaku Kogyo Kabushiki Kaisha) | 16.5 parts |
| Polyhydric alcohol type nonionic surface-active agent: | |
| Polyglycerol stearate (trade name: CHIRABAZOL P-4, available from Taiyo Kagaku Co., Ltd.) | 2.0 parts |
| PMMA (polymethyl methacrylate) particles (average particle diameter: 7.5 μm; true density: 1.19 g/cm$^3$; length/breadth: 1.06) | 10 parts |

The roller-shaped electrophotographic conductive member obtained had a volume resistivity of $6.9\times10^5$ Ω·cm and a surface resistivity of $2.2\times10^6\Omega$. Also, in both the volume resistivity and the surface resistivity, their maximum values were within 30 times the minimum values in both the peripheral direction and the generatrix direction.

A voltage of 500 V was applied to the roller-shaped electrophotographic conductive member obtained, and no leaks occurred.

The roller-shaped electrophotographic conductive member obtained was visually observed. As a result, neither foreign matter, such as protrusions or fish eyes, nor any sign of faulty extrusion were seen on the surface. This is considered to be due to the fact that the polyhydric alcohol type nonionic surface-active agent resulted in a sufficiently high dispersion effect so as to cause no agglomerate of the conductive filler.

The roller-shaped electrophotographic conductive member obtained was set as a developing roller in the electrophotographic apparatus set up as shown in FIG. 4, and a full-color image reproduction test was conducted in an environment of 15° C./10% RH. As a result, no image density non-uniformity due to resistance non-uniformity of the developing roller was seen from the start, and good images were obtainable. Incidentally, as the above roller-shaped electrophotographic conductive member, four members were prepared, and these were used as the four developing rollers of the electrophotographic apparatus set up as shown in FIG. 4.

Using the electrophotographic apparatus set up as shown in FIG. 4, a roller-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, the surface of the electrophotographic photosensitive member was seen not to have been contaminated. Thereafter, image reproduction was tested. As a result, no faulty images, such as black lines and white areas, were seen at the part corresponding to that where the roller-shaped electrophotographic conductive member and the electrophotographic photosensitive member were kept in contact. Also, the surface resistivity of the roller-shaped electrophotographic conductive member having been left for a month under the above-discussed environmental conditions was $1.4\times10^6\Omega$, which differed little from the value before contact. Thus, the performance of the electrophotographic conductive member was observed to have changed even when it was left in a severe environment.

Comparative Example 1

A belt-shaped electrophotographic conductive member was produced in the same manner as in Example 1, except that the polyhydric alcohol type nonionic surface-active agent was not used.

The belt-shaped electrophotographic conductive member obtained had a volume resistivity of $3.2\times10^8$ Ω·cm and a surface resistivity of $6.5\times10^8\Omega$. Also, in both the volume resistivity and the surface resistivity, their maximum values were 800 times the minimum values in both the peripheral direction and the generatrix direction. This is considered to be due to the fact that the conductive carbon black was non-uniformly dispersed.

A voltage of 500 V was applied to the belt-shaped electrophotographic conductive member obtained, and a leak due to protrusions occurred. Sections of the protrusions of the belt-shaped electrophotographic conductive member were observed. As a result, agglomerates of the conductive carbon black were seen.

The belt-shaped electrophotographic conductive member obtained was set as an intermediate transfer belt in the electrophotographic apparatus set up as shown in FIG. 4, and a full-color image reproduction test was conducted in an environment of 15° C./10% RH. As a result, transfer efficiency (the product of primary transfer efficiency and secondary transfer efficiency) was 90% at a maximum and 80% at a minimum. Thus, the transfer efficiency was insufficient and transfer non-uniformity was also seen. In particular, the transfer was insufficient at protrusion areas, and blank areas appeared at the part corresponding to the protrusion areas.

Comparative Example 2

A belt-shaped electrophotographic conductive member was produced in the same manner as in Example 1 except, that 0.5 part of the polyhydric alcohol type nonionic surface-active agent polyglycerol poly-ricinolate was changed for 1.5 parts of beef tallow diamine dioleate.

The belt-shaped electrophotographic conductive member obtained had a volume resistivity of $8.5\times10^{8}$ Ω·cm and a surface resistivity of $9.8\times10^{8}$Ω. Also, in both the volume resistivity and the surface resistivity, their maximum values were 150 times the minimum values in both the peripheral direction and the generatrix direction. This is considered due to the fact that the conductive carbon black was non-uniformly dispersed.

A voltage of 500 V was applied to the belt-shaped electrophotographic conductive member obtained, where a leak due to protrusions occurred. Sections of the protrusions of the belt-shaped electrophotographic conductive member were observed. As a result, agglomerates of the conductive carbon black were seen.

The belt-shaped electrophotographic conductive member obtained was set as an intermediate transfer belt in the electrophotographic apparatus set up as shown in FIG. 4, and a full-color image reproduction test was conducted in an environment of 15° C./10% RH. As the result, transfer efficiency (the product of primary transfer efficiency and secondary transfer efficiency) was 92% at a maximum and 85% at a minimum. Thus the transfer efficiency was insufficient and transfer non-uniformity was also seen. In particular, the transfer was insufficient at protrusion areas, and blank areas appeared at the part corresponding to the protrusion areas.

Using the electrophotographic apparatus set up as shown in FIG. 4, a belt-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, white lines were seen on the surface of the electrophotographic photosensitive member. Thereafter, image reproduction was tested. As a result, line-shaped faulty images appeared at the part corresponding to that where the belt-shaped electrophotographic conductive member and the electrophotographic photosensitive member were kept in contact. This electrophotographic photosensitive member was observed. As a result, fine cracks were seen on the surface. Also, the surface resistivity of the belt-shaped electrophotographic conductive member having been left for a month under the above-discussed environmental conditions was $5.9\times10^{7}$Ω, which differed greatly from the value before contact. Thus, the performance of the electrophotographic conductive member changed when it was left in a severe environment. As a result of being subjected to such conditions for a month, the transfer efficiency was further lowered so that it was 80% at a maximum and 72% at a minimum.

Comparative Example 3

A belt-shaped electrophotographic conductive member was produced in the same manner as in Example 3, except that the polyhydric alcohol type nonionic surface-active agent was not used.

The belt-shaped electrophotographic conductive member obtained had a volume resistivity of $3.4\times10^{9}$ Ω·cm and a surface resistivity of $4.6\times10^{9}$Ω. Also, in both the volume resistivity and the surface resistivity, their maximum values were 150 times the minimum values in both the peripheral direction and the generatrix direction. This is considered to be due to the fact that the conductive carbon black was non-uniformly dispersed.

The belt-shaped electrophotographic conductive member obtained was set as an intermediate transfer belt in the electrophotographic apparatus set up as shown in FIG. 6, and a full-color image reproduction test was conducted in an environment of 15° C./10% RH. As a result, transfer efficiency (the product of primary transfer efficiency and secondary transfer efficiency) was 92% at a maximum and 85% at a minimum. Thus, the transfer efficiency was insufficient and transfer non-uniformity was also seen. In particular, the transfer was insufficient at protrusion areas, and blank areas appeared at the part corresponding to the protrusion areas.

Comparative Example 4

A belt-shaped electrophotographic conductive member was produced in the same manner as in Example 4, except that 0.7 part of the polyhydric alcohol type nonionic surface-active agent condensed polyglycerol stearate was changed for 1.5 parts of beef tallow diamine dioleate.

The belt-shaped electrophotographic conductive member obtained had a volume resistivity of $8.1\times10^{10}$ Ω·cm and a surface resistivity of $1.3\times10^{11}$Ω. Also, in both the volume resistivity and the surface resistivity, their maximum values were 120 times the minimum values in both the peripheral direction and the generatrix direction. This is considered to be due to the fact that the conductive carbon black was non-uniformly dispersed.

The belt-shaped electrophotographic conductive member obtained was set as a transfer material transporting belt in the electrophotographic apparatus set up as shown in FIG. 5, and a full-color image reproduction test was conducted in an environment of 15° C./10% RH. As a result, image density non-uniformity due to resistance non-uniformity of the transfer material transporting belt appeared from the initial stage, and blank areas caused by poor transfer due to leak also appeared. Thus, good images were not obtainable. Further, a 10,000-sheet running test was conducted, where filming of toner occurred on the surface of the transfer material transporting belt.

Using the electrophotographic apparatus set up as shown in FIG. 5, a belt-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, white lines were seen on the surface of the electrophotographic photosensitive member. Thereafter, image reproduction was tested. As a result, line-shaped faulty images appeared at the part corresponding to that where the belt-shaped electrophotographic conductive member and the electrophotographic photosensitive member were kept in contact. This electrophotographic photosensitive member was observed. As a result, fine cracks were seen on the surface. Also, the surface resistivity of the belt-shaped electrophotographic conductive member having been left for a month under the above-discussed conditions was $3.3\times10^{8}$Ω, which differed greatly from the value before contact. Thus, the performance of the electrophotographic conductive member was observed to have changed when it was left in a severe environment. Also, as a result of a lowering of surface resistivity, the ability to attract and hold transfer materials decreased, causing image aberrations.

Comparative Example 5

A seamless tube was produced in the same manner as in Example 5, except that 0.5 part of the polyhydric alcohol type nonionic surface-active agent polyglycerol poly-ricinolate was changed for 1.5 parts of beef tallow diamine dioleate. Also, a roller-shaped electrophotographic conductive member was produced in the same manner as in Example 5.

The roller-shaped electrophotographic conductive member obtained had a volume resistivity of $7.7\times10^6$ Ω·cm and a surface resistivity of $8.7\times10^6$Ω. Also, in both the volume resistivity and the surface resistivity, their maximum values were 130 times the minimum values in both the peripheral direction and the generatrix direction.

The roller-shaped electrophotographic conductive member obtained was set as a primary charging roller in the electrophotographic apparatus set up as shown in FIG. 3, and an image reproduction test was conducted in an environment of 15° C./10% RH. As a result, image density non-uniformity due to resistance non-uniformity of the primary charging roller appeared from the initial stage. Here, bias voltage was applied to the primary charging roller under the conditions of a peak-to-peak voltage of 2.3 kV, a frequency of 400 Hz and a DC voltage of −700 V.

Using the process cartridge of the electrophotographic apparatus set up as shown in FIG. 3, a roller-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, white lines were seen on the surface of the electrophotographic photosensitive member. Thereafter, image reproduction was tested. As a result, line-shaped faulty images appeared at the part corresponding to that where the roller-shaped electrophotographic conductive member and the electrophotographic photosensitive member were kept in contact. This electrophotographic photosensitive member was observed. As a result, fine cracks were seen on the surface.

Comparative Example 6

A seamless tube was produced in the same manner as in Example 7, except that 1.0 part of the polyhydric alcohol type nonionic surface-active agent polyglycerol poly-ricinolate was changed for 1.5 parts of beef tallow diamine dioleate. Also, a roller-shaped electrophotographic conductive member was produced in the same manner as in Example 7.

The roller-shaped electrophotographic conductive member obtained had a volume resistivity of $3.8\times10^5$ Ω·cm and a surface resistivity of $6.2\times10^5$Ω. Also, in both the volume resistivity and the surface resistivity, their maximum values were 150 times the minimum values in both the peripheral direction and the generatrix direction.

The roller-shaped electrophotographic conductive member obtained was set as a developing roller in the electrophotographic apparatus set up as shown in FIG. 4, and a full-color image reproduction test was conducted in an environment of 15° C./10% RH. As a result, image density non-uniformity due to resistance non-uniformity of the developing roller appeared from the initial stage. Incidentally, as the above roller-shaped electrophotographic conductive member, four members were prepared, and these were used as the four developing rollers of the electrophotographic apparatus set up as shown in FIG. 4.

Using the electrophotographic apparatus set up as shown in FIG. 4, a roller-shaped electrophotographic conductive member also produced in the same manner as the above was brought into contact with the electrophotographic photosensitive member, and these were left for a month in an environment of 40° C./95% RH. Thereafter, the electrophotographic photosensitive member was visually observed. As a result, white lines were seen on the surface of the electrophotographic photosensitive member. Thereafter, image reproduction was tested. As a result, line-shaped faulty images appeared at the part corresponding to that where the roller-shaped electrophotographic conductive member and the electrophotographic photosensitive member were kept in contact. This electrophotographic photosensitive member was observed. As the result, fine cracks were seen on the surface.

What is claimed is:

1. An electrophotographic conductive member comprising a thermoplastic resin composition, wherein said thermoplastic resin composition contains a thermoplastic resin, a conductive filler and a conductive-filler dispersing agent, and the conductive-filler dispersing agent is polyglycerol poly-ricinolate or polyglycerol stearate.

2. The electrophotographic conductive member according to claim 1, wherein said conductive filler is carbon black.

3. The electrophotographic conductive member according to claim 1, wherein said dispersing agent is contained in said thermoplastic resin composition in an amount of from 1% by weight to 20% by weight based on the weight of the conductive filler in said thermoplastic resin composition.

4. The electrophotographic conductive member according to claim 1, which has the shape of a belt.

5. The electrophotographic conductive member according to claim 4, which is a transfer material transporting belt.

6. The electrophotographic conductive member according to claim 1, which has the shape of a roller.

7. An electrophotographic apparatus comprising an electrophotographic conductive member comprising a thermoplastic resin composition, wherein said thermoplastic resin composition contains a thermoplastic resin, a conductive filler and a conductive-filler dispersing agent, and the conductive-filler dispersing agent is polyglycerol poly-ricinolate or polyglycerol stearate.

* * * * *